United States Patent [19]

Boyd

[11] 4,255,826

[45] Mar. 17, 1981

[54] NAIL POLISH REMOVER

[76] Inventor: Raymond Boyd, 2235 Cambridge Rd., Broomall, Pa. 19008

[21] Appl. No.: 35,228

[22] Filed: May 2, 1979

[51] Int. Cl.[3] ..... A45D 29/17; A46B 13/04

[52] U.S. Cl. ..... 15/21 R; 15/97 R; 15/104.92; 132/74.5; D28/58

[58] Field of Search ..... 132/73, 73.6, 74.5, 132/75, 75.8, 76.4, 76.5; 15/21 A, 21 C, 97 R, 21 D, 167 B, 21 R, 104.92; D28/58; D15/35, 36, 56; 206/210; 220/20

[56] References Cited

U.S. PATENT DOCUMENTS

| | | | |
|---|---|---|---|
| 1,366,306 | 1/1921 | Wick | 15/21 C |
| 2,713,693 | 7/1955 | Johnson | 15/97 R |
| 2,771,621 | 11/1956 | Erickson | 15/167 B |
| 2,952,859 | 9/1960 | Alcamo | 15/97 R |
| 4,022,228 | 5/1977 | Ropp et al. | 132/75 |

*Primary Examiner*—Ivars C. Cintins
*Assistant Examiner*—David R. Sadowski
*Attorney, Agent, or Firm*—Benasutti Associates, Ltd.

[57] ABSTRACT

A motor driven cup member is mounted on a support structure for rotation about a vertical axis. The support structure also houses and supports the motor and the power supply for the motor. The cup is divided into two sections, the upper section including a brush element lining the interior wall thereof and the lower section being adapted to contain a supply of nail polish remover solution. An electric switch supported by the support structure is operated with one hand while the fingers of the other hand are inserted, one at a time, into the cup to remove the nail polish from the nails thereof. A cover adapted to enclose the support structure includes a seal which seals against the top of the cup thereby preventing evaporation of the solution.

5 Claims, 6 Drawing Figures

NAIL POLISH REMOVER

BACKGROUND OF THE INVENTION

The present invention is directed toward a nail polish remover and more particularly toward a motor driven nail polish remover which automatically and conveniently removes nail polish from fingernails. Individuals who wear nail polish rarely reapply polish over old polish. Rather, the initial polish is first removed before the new polish is applied. Furthermore, it is sometimes desired to merely remove the old nail polish without reapplying new polish.

Nail polish is normally removed with the use of a liquid commonly referred to as nail polish remover. The primary active ingredient in most nail polish remover solutions is acetone. The acetone dissolves the nail polish when it comes in contact with the hardened polish on an individual's nails.

Normally nail polish is removed by applying the remover solution to a cotton ball and thereafter rubbing the cotton ball against the polished nail. This is not only time consuming but is often an extremely messy operation. This process is particularly detrimental when it is desired to remove the nail polish from less than all of a person's nails. When one attempts to do this, the solution invariably contacts the other nails thereby ruining the polish thereon.

Insofar as Applicant is aware, only one attempt has been made to provide a nail polish removing device. This prior device is described in U.S. Pat. No. 2,771,621. The patented device includes a container with an opening at the top thereof through which one can insert the tip of a finger. A brush attached to the end of a plunger which extends upwardly through the top of the device is adapted to contact the fingernail within the container. This device has numerous drawbacks which makes it undesirable. For example, the necessity for the plunger which extends upwardly from the container makes the device relatively large. In addition, the device must be manually operated. That is, one hand must move the plunger up and down while the nails of the other hand are being cleaned of polish. This not only can become tiring but also leaves no hand available to hold the device from moving or tipping. Even further, no means are provided for replacing the brush in the event that the same becomes worn.

Applicant is aware of no other attempts to design a nail polish removing device. There has, however, been a need for a device which automatically and conveniently removes nail polish from fingernails and which, at the same time, prevents the nail polish removing solvent from contacting and damaging adjacent objects or furniture.

SUMMARY OF THE INVENTION

The present invention overcomes the deficiencies of the prior art described above and provides a device which automatically and conveniently removes nail polish. This is accomplished by a motor driven cup member which is mounted on a support structure for rotation about a vertical axis. The support structure also houses and supports the motor and the power supply for the motor. The cup is divided into two sections, the upper section including a brush element lining the interior wall thereof and the lower section being adapted to contain a supply of nail polish remover solution. An electric switch supported by the support structure is operated with one hand while the fingers of the other hand are inserted, one at a time, into the cup to remove the nail polish from the nails thereof. A cover adapted to enclose the support structure includes a seal which seals against the top of the cup thereby preventing evaporation of the solution.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
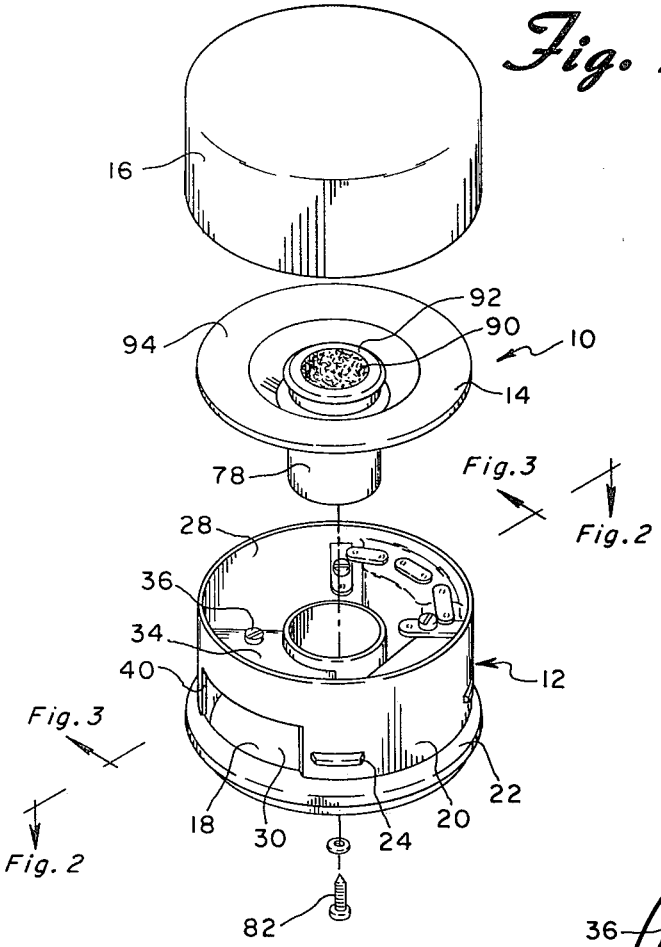
FIG. 1 is an exploded perspective view of a nail polish remover constructed in accordance with the principles of the present invention.

Referring now to the drawings in detail wherein like reference numerals have been used throughout the various figures to designate like elements, there is shown in FIG. 1 an exploded perspective view of a nail polish remover constructed in accordance with the principles of the present invention and designated generally as 10. FIG. 1 is shown exploded so as to more clearly illustrate the structure of the device.

The nail polish remover 10 as shown in FIG. 1 is comprised essentially of three major component parts. These are the main housing and structural support or base member 12, the flanged cup member 14 and the cover 16. The base member 12 is comprised essentially of a cylindrically shaped housing having a bottom wall 18 and upwardly extending cylindrical side walls 20. Located on the cylindrical side walls adjacent the lower portion thereof is an outwardly extending ridge 22. As will become more apparent hereinafter, the purpose of ridge 22 is to limit the downward movement of cover member 16 when the cover is in place. Also extending outwardly from the cylindrical side walls 20 in a position slightly above ridge 22 are a plurality of projections 24. As will also become apparent hereinafter, these projections 24 are adapted to mate with similar projections on the cover member 16 to lock the cover member 16 in place.

Also extending upwardly from the bottom wall 18 is an inner cylindrical wall 26. Inner cylindrical wall 26 is coaxial with cylindrical side walls 20 but has a height slightly less than the height of side walls 20. An annular space 28 remains between the inner cylindrical wall 26 and the cylindrical side walls 20.

Figure 3:
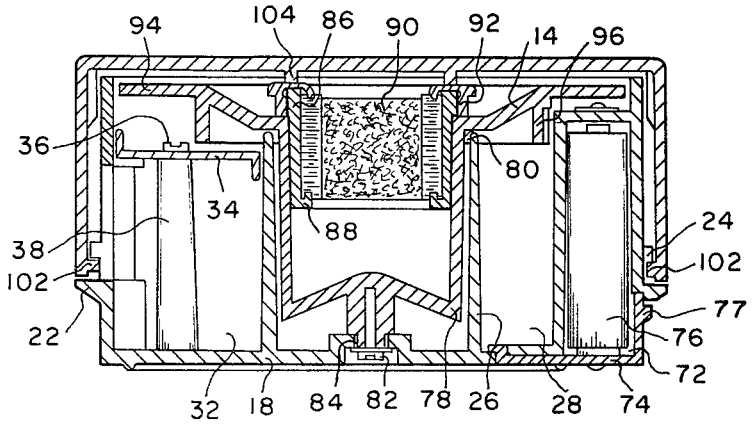
FIG. 3 is a cross sectional view taken along the lines 3—3 of FIG. 1.

Located within this annular space 28 is a compartment 30 which is particularly adapted to hold a supply of cotton balls or the like. Compartment 30 is bounded on the bottom by a portion of bottom wall 18. The sides are bounded by radially extending side walls only one of which, 32, being shown (FIG. 3). The rear of the compartment 30 is bounded by the inner cylindrical wall 26 and the front wall is bounded in part by the inner surface of the cylindrical side walls 20. A cover member 34 is screwed onto the side walls by screws 36 which are secured to bosses 38 integral with the side walls. Compartment 30 is open at the front thereof through an opening 40 in the cylindrical side walls 20 so as to make the compartment 30 accessible when the cover 16 is removed.

Also located in the annular space 28 in a position adjacent the compartment 30 is a small electric motor 42. Motor 42 is mounted on one end of U-shaped bracket 44 and is arranged so as to be vertically oriented. The other end of U-shaped bracket 44 is pivotally mounted on post 46 which extends upwardly from the bottom wall 18. (See FIG. 5). The lowermost portion 48 of post 46 is enlarged to maintain the U-shaped bracket 44 and the motor 42 at the proper vertical elevation.

Figure 2:
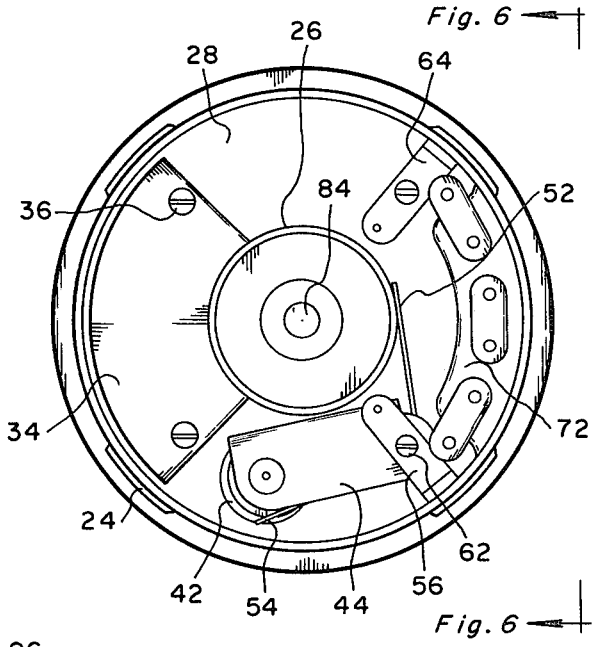
FIG. 2 is a cross sectional view taken along the lines 2—2 of FIG. 1.

A coil spring 50 around post 46 has the lower leg 52 thereof extending toward and resting against the outside surface of the inner cylindrical wall 26. (See FIG. 2). The upper leg 54 of coil spring 50 extends outwardly and rests against the upper outside portion of motor 42. As a result of the tension of coil spring 50, motor 42 is biased radially inwardly.

Mounted on top of post 46 are a pair of metal strips 56 and 58. An insulator 60 separates the metal strips 56 and 58 which are held in place by screw 62. The forward ends of the metal strips 56 and 58 are bent downwardly and terminate adjacent the cylindrical side walls 20 of base member 12.

The metal strips 56 and 58 form the contacts of an electrical switch which is used to turn the motor 42 on and off. The electrical connections between the switch, the motor and the power supply are well known and accordingly it is not believed that a detailed description thereof is necessary. Another switch similar to the switch comprised of the metal strips 56 and 58 is also mounted in the annular space 28 at a position approximately 90° therefrom. This second switch is indicated at 64 in FIG. 2 and is wired so as to be in parallel with the first switch.

Figure 5:
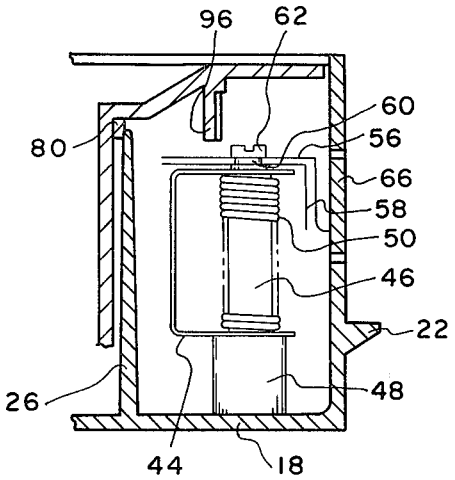
FIG. 5 is a cross sectional view showing the details of the motor mounting post and switch.
Figure 6:
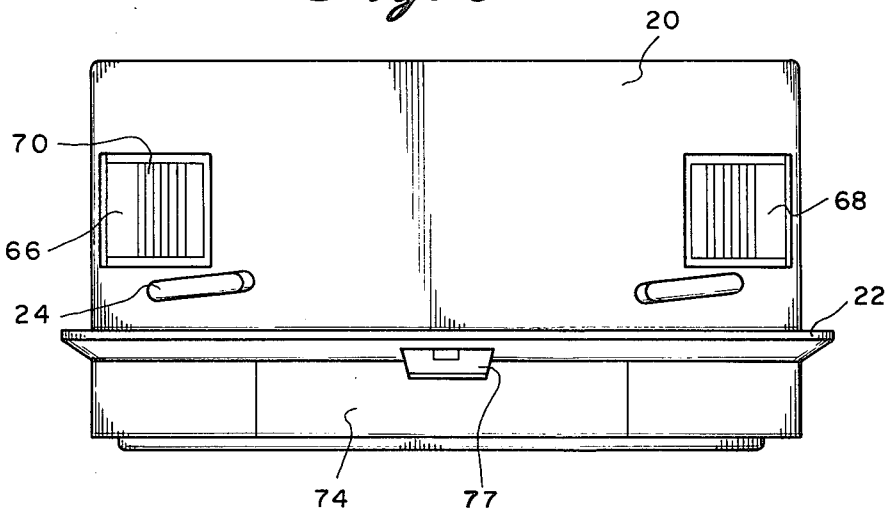
FIG. 6 is a rear elevational view of the device shown in FIG. 1.

As shown most clearly in FIGS. 5 and 6, tabs 66 and 68 are provided in the cylindrical side wall 20 in positions directly behind the switch contacts. Tabs 66 and 68 are produced by cutting away three sides of a rectangular portion thereby leaving the same suspended by only one side thereof. The tabs 66 and 68 can therefore be flexed inwardly when desired to close the switch. A series of grooves and/or raised portions 70 on the tabs aid in locating the tabs and increases friction so that the tabs may be pushed in without one's finger slipping therefrom. Tabs 66 and 68 and the entire cylindrical side walls 20 are comprised of a semirigid plastic material which allows the tabs to flex back to their original position after they have been moved inwardly to close the switch.

Located between the two switches and in the annular space 28 is a battery compartment 72. The lower door 74 closes the battery compartment 72 which battery compartment is adapted to hold four batteries 76. The batteries 76 are connected in series in the known manner and are connected to the motor and switches in the conventional manner. When it is desired to gain access to the battery compartment, the battery door 74 is pivotted downwardly with the aid of the handle portion 77.

In lieu of or in addition to the battery compartment 72, the nail polish remover 10 could be provided with a step down power supply which may allow the device to be operated from a conventional 120 volt electrical outlet. Such a power supply could also be mounted in the annular space 28 adjacent the far side of the compartment 30. A jack or similar connector passing through the side wall 20 may be provided for connecting the power supply to an electrical outlet.

The second main portion of the nail polish remover 10 is the flanged cup member 14 shown most clearly in FIGS. 1 and 3. Member 14 includes a central cup shaped portion 78. Cup 78 has an outer diameter slightly less than the inner diameter of the inner cylindrical wall 26. A bearing 80 located between the cup 78 and the wall 26 allows the cup to rotate freely. A screw 82 passes through hole 84 in the bottom wall 18 through the base 12 and is threaded into the center portion of the cup 78. The connection between the screw 82, the wall 18 and the cup 78 is such, however, so as to allow the cup to rotate freely.

Cup 78 is adapted to hold a small supply of fingernail polish remover solution. When the cup rotates in a manner to be described in more detail hereinafter, the solution moves outwardly by centrifugal force against the impervious side walls of the cup 78 and proceeds upwardly up the walls. Because of this feature, only a small amount of solution is needed to coat a fingernail which passes through the top of the cup and is pressed against the inner side wall of the cup 78. To aid in guiding the fingernail toward the side wall of the cup 78, the bottom wall of the cup 78 is high at the center portion thereof and decreases radially outwardly. Thus, when one's finger is placed into the cup it slides downwardly toward the side wall.

Secured to the inside of the upper half of cup 78 is a cylindrically shaped cup insert 86. Insert 86 has a partial bottom wall 88. This bottom wall 88 serves two functions. Firstly, it prevents upward movement of the solution in the cup 78 which tends to move upwardly because of centrifugal force. Secondly, the lower wall 88 forms a support for the cylindrically shaped brush 90 which is removably mounted in the insert 86. Brush 90 is preferably made of mohair on other natural fibers so that it cannot only effectively brush the nail being forced against it but also withstands the corrosive effect of the acetone in the nail polish remover solution. Brush 90 is held in place by a flexible ring cap 92 which snaps over the upper end of the insert 86 and the brush 90.

As should be readily apparent, the entire flanged cup member 14 and all of the components associated therewith are comprised of a material which resists the corrosive effects of the acetone in the nail polish remover solution. It has been found that a suitable plastic material for this purpose is polyethylene. However, numerous other materials could also be used.

Figure 4:
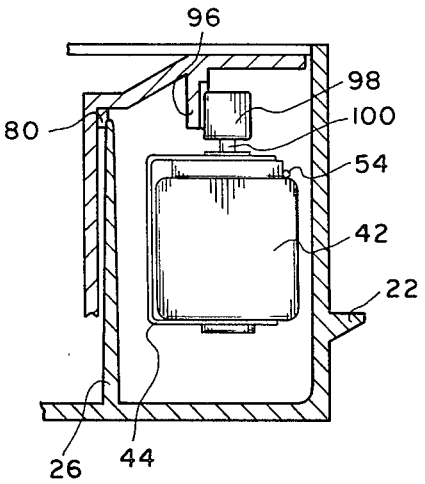
FIG. 4 is a cross sectional view showing the details of the motor drive.

Extending radially outwardly from the upper portion of the central cup member 78 is a horizontally disposed annular flange 94. As shown most clearly in FIG. 3, flange 94 extends over and protects all of the components within the annular space 28. Extending downwardly from the flange 94 is a cylindrically shaped flange 96. As shown in FIG. 4, cylindrical flange 96 is engaged by friction drive means 98 secured to the drive shaft 100 of motor 42. It should be recalled that spring 50 constantly urges motor 42 and therefore friction drive means 98 into engagement with the cylindrical flange 96 to thereby rotate the entire flanged cup 14 when one of the switches is closed.

The third major component of the nail polish remover 10 is the cover member 16. As shown most clearly in FIG. 3, the cylindrically shaped cover member 16 has an inner diameter slightly greater than the outer diameter of the cylindrical side walls 20 of the base member 12. The cover member 16 therefore fits easily over the base member 12 and rests on the ridge 22.

Extending inwardly from the lower portion of the side walls of the cover member 16 are a plurality of projections 102. With the cover member 16 in place, it is turned slightly so that the projections 102 engage the projections 24 on the cylindrical side wall 20 so as to lock the cover in place. A further ring shaped projection 104 extends downwardly from the top of the cover 16 and seals against the top of the flexible ring cap 92. As a result, with the cover 16 in place, the cup 78 is sealed to prevent evaporation or leakage of the nail polish remover solution within the cup 78.

The nail polish remover 10 of the present invention is utilized in the following manner. Firstly, the cover member 16 is rotated slightly to disengage the projections 24 and 102 and is then removed. If the cup 78 is empty, a capful of nail polish remover solution is poured into the cup. The base 12 is then held with one hand by positioning the thumb in the area of the cotton compartment 30 and stretching the fingers of the hand around the back of the base. Tab 66 or 68 is then depressed by one of the fingers of the hand thereby causing the cup 78 and the entire flanged cup member 14 to rotate. This causes the solution in the cup 78 to move outwardly by centrifugal force and to begin to move upwardly against the walls of the cup 78. One of the fingers of the other hand is then inserted into the nail polish remover through the opening at the top of the cup 78 and as the tip of the finger hits the bottom wall of the cup, it automatically slides to the side wall so that the nail contacts the solution clinging to the wall. After the nail is coated with the solution, the finger is raised slightly until the nail is directly opposite the rotating brush 90. At this point, the nail is pushed against the brush and is preferably rotated back and forth until all of the nail polish is removed from the nail.

It has been found that the capful of solution in the cup 78 can be used over and over again. However, new solution can be added whenever desired and if desired, the old solution can be drained from the cup merely by turning the device upside down over a sink or other drain. Similarly, if it is ever desired to remove the brush, this is easily done by first snapping the flexible ring cap 92 off of the top of the insert 86. The brush is then easily slid upwardly and removed and is replaced in the same manner.

The present invention may be embodied in other specific forms without departing from the spirit or essential attributes thereof and, accordingly, reference should be made to the appended claims rather than to the foregoing specification as indicating the scope of the invention.

I claim:

1. A nail polish remover comprising:

a support means;

a substantially cylindrically shaped cup means supported by said support means so as to be rotatable about a substantially vertical axis, said cup means having impervious cylindrical side walls and being adapted to contain a quantity of a solvent solution therein;

a substantially cylindrically shaped brush means carried by said cup means for rotation therewith, said brush means being open at the center thereof whereby a finger may be inserted therein and the nail pressed against the same;

motor means carried by said support means for rotating said cup means and said brush means about said vertical axis, and a cover means for covering at least a part of said support means, said cover means including means engaging the upper portion of said cup means for sealing said cup means closed when said cover means is in place.

2. A nail polish remover as claimed in claim 1 wherein said brush means is mounted within said cup means adjacent at least the upper portion thereof.

3. A nail polish remover as claimed in claim 1 wherein said cup means includes a bottom wall having a raised portion adjacent the center thereof, said raised portion allowing a person's finger to slide downwardly therefrom so as to guide the same toward said side walls.

4. A nail polish remover as claimed in claim 1 further including a substantially horizontally disposed annular flange extending radially outwardly from the upper portion of said cup means, said flange extending over at least part of said support means for protecting at least some of the components mounted thereon and being rotatable with said cup means.

5. A nail polish remover as claimed in claim 1 wherein said motor means is comprised of an electric motor and further including an electric power source carried by said support means and electrical switch means.

* * * * *